US007703617B1

(12) United States Patent
Branson et al.

(10) Patent No.: US 7,703,617 B1
(45) Date of Patent: Apr. 27, 2010

(54) BAYONET CLOSURE CONTAINER COMBINATION WITH ANGLED BAYONET LUGS

(75) Inventors: Mark K. Branson, Newburgh, IN (US); Clifton C. Willis, Evansville, IN (US)

(73) Assignee: Rexam Closures and Containers, Inc., Evansville, IN (US)

( * ) Notice: Subject to any disclaimer, the term of this patent is extended or adjusted under 35 U.S.C. 154(b) by 1092 days.

(21) Appl. No.: 10/994,038

(22) Filed: Nov. 19, 2004

(51) Int. Cl.
*B65D 41/06* (2006.01)

(52) U.S. Cl. ..... 215/332; 215/222; 215/342; 215/349; 220/293; 220/298

(58) Field of Classification Search ..... 215/216–222, 215/329–332, 342, 349; 220/293, 298
See application file for complete search history.

(56) References Cited

U.S. PATENT DOCUMENTS 826,796 A * 7/1906 McManus ..... 215/332
3,128,006 A * 4/1964 Rousselet ..... 220/295
3,371,813 A * 3/1968 Owen et al. ..... 215/318
3,595,417 A * 7/1971 Musher ..... 215/222
3,613,928 A * 10/1971 Landen ..... 215/214
3,809,276 A * 5/1974 Landen ..... 215/332
3,855,997 A * 12/1974 Sauer ..... 600/573
3,951,289 A * 4/1976 Landen ..... 215/211
3,974,928 A 8/1976 Domaracki et al.
4,049,148 A 9/1977 Suhr et al.
4,059,198 A * 11/1977 Mumford ..... 215/222
4,071,156 A * 1/1978 Lowe ..... 215/224
4,270,664 A 6/1981 Buono
4,298,129 A * 11/1981 Stull ..... 215/224
4,320,844 A * 3/1982 Cooper ..... 215/260
4,335,823 A * 6/1982 Montgomery et al. ..... 215/206
4,346,809 A * 8/1982 Kusz ..... 215/214
4,383,619 A * 5/1983 Mumford et al. ..... 215/222
4,387,817 A 6/1983 Wiles et al.
4,387,821 A * 6/1983 Geiger ..... 215/330
4,394,918 A * 7/1983 Grussen ..... 215/243
4,399,920 A * 8/1983 Swartzbaugh et al. ..... 215/211
4,434,903 A * 3/1984 Cooke ..... 215/222
4,526,281 A * 7/1985 Herr ..... 215/211
4,530,438 A * 7/1985 McDevitt ..... 215/252
4,627,547 A 12/1986 Cooke
4,635,808 A * 1/1987 Nolan ..... 215/252
4,640,430 A * 2/1987 Haines ..... 215/330
4,721,219 A * 1/1988 Dullabaun et al. ..... 215/274
4,739,890 A * 4/1988 Cooke ..... 215/222

(Continued)

*Primary Examiner*—Anthony Stashick
*Assistant Examiner*—Ned A Walker
(74) *Attorney, Agent, or Firm*—James E. Cole; Middleton Reutlinger

(57) ABSTRACT

A safety closure for use on a container neck having a closure top wall, an annular sidewall depending downwardly from an outer periphery of the top wall defining an open bottom opposite the top wall. The sidewall has inner annular surface with a plurality of lugs projecting inward therefrom, wherein each lug has a lug top surface forming an angle of incidence of greater than 90° with the inner annular surface of the annular sidewall. The plurality of lugs are engageable with a plurality of lug receiving notches in a plurality of bayonet lugs on a container neck. A spring member depends from the closure top wall and is resiliently engageable with the container neck to bias the safety closure away from the container neck. Optional closure retaining means may be incorporated within the closure, container, or both.

8 Claims, 14 Drawing Sheets

U.S. PATENT DOCUMENTS

| | | | | | |
|---|---|---|---|---|---|
| 4,742,929 | A | * | 5/1988 | Desai | 215/332 |
| 4,877,144 | A | * | 10/1989 | Thanisch | 215/330 |
| 4,934,547 | A | * | 6/1990 | Mayes et al. | 215/306 |
| 4,991,729 | A | * | 2/1991 | Hunter | 215/206 |
| 5,020,681 | A | * | 6/1991 | Kusz | 215/220 |
| 5,092,477 | A | * | 3/1992 | Johnson et al. | 215/230 |
| 5,150,804 | A | * | 9/1992 | Blanchet et al. | 220/212 |
| 5,320,233 | A | * | 6/1994 | Welch | 215/252 |
| 5,413,233 | A | * | 5/1995 | Hall | 215/209 |
| 5,542,556 | A | * | 8/1996 | Ohmi et al. | 215/329 |
| 5,762,215 | A | * | 6/1998 | Ogden | 215/220 |
| 5,782,369 | A | * | 7/1998 | Tansey | 215/344 |
| 5,927,532 | A | * | 7/1999 | Traub | 215/342 |
| 6,015,054 | A | * | 1/2000 | King et al. | 215/252 |
| 6,056,136 | A | * | 5/2000 | Taber et al. | 215/252 |
| 6,085,922 | A | * | 7/2000 | Esser | 215/331 |
| 6,123,212 | A | * | 9/2000 | Russell et al. | 215/330 |
| 6,152,315 | A | | 11/2000 | Montgomery | |
| 6,170,683 | B1 | * | 1/2001 | Montgomery | 215/235 |
| 6,227,391 | B1 | * | 5/2001 | King | 215/307 |
| 6,450,352 | B1 | | 9/2002 | DeJonge | |
| 6,523,709 | B2 | * | 2/2003 | Miceli et al. | 215/228 |
| 6,557,714 | B2 | * | 5/2003 | Babcock et al. | 215/252 |
| 6,659,297 | B2 | * | 12/2003 | Gregory et al. | 215/252 |
| 6,988,642 | B2 | * | 1/2006 | Gallo et al. | 222/506 |
| 7,021,477 | B2 | * | 4/2006 | Wolfe | 215/222 |
| 2003/0121877 | A1 | | 7/2003 | Brozell et al. | |
| 2004/0169000 | A1 | * | 9/2004 | Ramsey | 215/219 |
| 2004/0173562 | A1 | * | 9/2004 | Wolfe | 215/222 |
| 2005/0150857 | A1 | * | 7/2005 | Brozell et al. | 215/204 |
| 2005/0189313 | A1 | * | 9/2005 | Walters | 215/305 |

* cited by examiner

BAYONET CLOSURE CONTAINER COMBINATION WITH ANGLED BAYONET LUGS

CROSS-REFERENCE TO RELATED APPLICATIONS

Not applicable.

STATEMENT REGARDING FEDERALLY SPONSORED RESEARCH OR DEVELOPMENT

Not applicable.

FIELD OF INVENTION

The present invention relates to safety closures for use on containers. More particularly, the present invention relates to a more efficiently manufacturable child resistant safety closure for use on a container having bayonet lugs.

BACKGROUND OF THE INVENTION

The use of cooperating locking lugs on safety closures and containers to prevent children from gaining access to the contents of the container is well known in the prior art. Drugs, corrosive products, and antifreeze are examples of substances that are commonly packaged in containers or bottles having child-resistant or safety closures. The closures and their complementary containers are designed to allow the user to open the container without allowing a child to open the same.

An example of a child resistant closure and container is a push-and-turn system which is typically used for pill containers. This system requires that the closure or cap for the pill container be pushed axially downwardly and rotated at the same time. These containers are typical a two-piece, ramp and lug design. Essentially, the closure comprises an inner cap and an outer cap which are rotatably attached to one another. A plurality of lugs on one cap project towards a plurality of corresponding ramps on the opposite cap. Generally, the ramps and lugs engage each other when turned in a fastening direction such that the two caps turn in tandem. However, when the cap is merely rotated in an "unfastening" direction, the lugs tend to slide over the ramps. The outer cap turns freely from the inner cap, and the inner cap remains fastened to the container. In order to open the cap, the outer cap must be pushed downward in order to counteract the tendency of the lugs to slide over the ramps while the cap is being turned.

Another safety closure found in the prior art has bayonet type closures in which one of the closure and the container has a set of bayonet lugs and the other has a set of mating lugs so that it is necessary to urge the closure toward the container while applying a rotative force in order to disengage the bayonet lugs from the mating lugs to remove the closure from the container.

A typical configuration of the bayonet type closures found in the prior art are such that they have lugs or other features in the cap or closure that have a lug top surface forming an angle near 90° with an inner annular surface of the closure. This lug top surface cooperates with a bayonet lug having a lug receiving notch where the lug receiving notch has a top surface forming an angle near 90° with an outer surface of the container neck. This "square" cooperation retains the closure on the container by countering an axial force on the closure.

This "square" configuration found in the prior art creates costly and inefficient manufacturing problems. In the injection molding process the closure is axially removed from a mold core. In order to accomplish this removal, a collapsible mold core is typically used or alternatively holes are placed in the top wall of the closure to remove a portion of the mold which forms the lug top wall. This provides channels in the mold core for the closure lugs thus enabling axial removal of the closure from the mold core.

SUMMARY OF THE INVENTION

It is an object of the present invention to provide a safety closure wherein the closure may be more easily removed from a forming mold thus making the manufacturing of the closure having lugs more efficient. Another objective of the present invention is to provide the increased manufacturing efficiency without substantially decreasing the ability of the closure to resist an axial removing force while in a sealing position on a container. Other objectives reached by the present invention will become apparent in the following descriptions.

A safety closure is provided with at least one lug having a top surface forming an angle of incidence with the inner annular surface of the closure in excess of 90°. Upon placing the closure in a sealing position on a container, the closure lug engages a bayonet lug having a closure lug receiving notch provided on a neck portion of the container. The closure is biased in a "locked" position on the container neck portion by at least one spring member. The spring member flexes against an upper surface of the container neck portion to provide an upward biasing force to the safety closure, thereby seating the lug into the bayonet and requiring the user to depress the safety closure downwardly against the spring member bias to unseat the lug.

A safety closure according to a preferred embodiment of the present invention includes having a top wall and a depending annular sidewall, the annular sidewall has a plurality of closure lugs projecting inward from an inner annular surface. The at least one lug on an inner annular surface of the closure is configured such that the manufacturing of the closure is accomplished more efficiently. The lugs on the closure each have a lug top surface which forms an angle of incidence with the inner annular surface of the closure in excess of 90°. Such a structural configuration allows the closure to be axially removed from a non-collapsible mold core and eliminates a necessity of putting holes in the closure top wall, as is associated with the prior art.

However, the angle of incidence of the lug top surface with the annular sidewall of the closure in excess of 90° may reduce the tendency for the lugs of the prior art to resist an axial removing force placed on the closure when in a sealed position. An axial force placed on a closure of the prior art having a lug of the present invention causes the lug to ride over the bayonet lug thus increasing the tendency of the closure wall to 'go square'. A closure wall "going square" means that closure wall segments between the lugs straighten thus causing the periphery of the closure to loose its circular configuration thus increasing the tendency of unwanted removal of the closure. Yet, several embodiments of a closure retaining feature or closure retaining means which are claimed herein eliminate or reduce the tendency for the closure lug top surface to rise over a receiving notch in a bayonet lug on a container neck thus securing the closure in a sealed position.

Each of the at least one or plurality of closure lugs are engageable with a lug receiving notch provided in a bayonet lug on a container neck portion. The closure, container, or both may optionally have a feature that increases the retention of the plurality of closure lugs in the lug receiving notches in the bayonet lugs on the container when an axial removing force is placed on the closure. Such a means for preventing axial removal of the closure may include having wedged shape lugs, wedge shaped lug receiving notches, wedged lugs and notches, a close fit between the closure and the container, a close proximity of lugs to a closure top wall, or even a reinforcing band around the closure.

Several embodiments of a closure retaining feature are claimed herein. However, it is to be understood that these retaining features are optional and that other of such features known to a person of ordinary skill in the art may be practiced and still be within the scope of the invention claimed herein. A closure retaining feature may not be needed and hence is not to be considered as a limitation on the presently claimed invention. If a closure retaining means is incorporated in an embodiment, it may be on the closure, container, or both. Embodiments of a closure having a retaining feature claimed herein include having sidewalls of lugs on a closure forming a wedge having a narrow end adjacent a top wall. This wedge provides for gripping within lug receiving notches in bayonet lugs on a container. Alternatively, the lug receiving notches in the bayonet lugs on the container may have a wedge configuration thus retaining square or wedge shaped closure lugs. Another closure retaining feature includes having a reinforcing band circumferentially surrounding a periphery of a closure and inwardly projecting lugs thus reducing the tendency of or preventing the closure from radially expanding or 'going square' upon the exertion of an axial force on the closure. Yet other retaining features include having a closure with lugs near a wall or having a snug fit between the closure and container so that the closure sidewall resists the tendency to radially expand or 'go square'.

DETAILED DESCRIPTION OF THE PREFERRED EMBODIMENTS

The present invention relates to a closure and container combination intended for use as a child-resistant closure wherein the closure has a plurality of lugs, each lug having a top surface forming an angle of incidence with an inner annular wall of a closure of greater than 90°. This angle of incidence provides for a more efficiently manufacturable design where the closure is more easily removed from a forming mold. However, this angle of incidence may also provide challenges in designing features in the closure and/or container that prohibits or reduces the tendency of unwanted axial removal of the closure from the container when the closure is in a sealing position on the container. Yet, the several embodiments of the present invention claimed herein incorporate optional structural features that provide for inhibiting the axial removal of the closure from the container when the closure is in a sealing position on the container. These closure retaining means include having a container neck near the closure depending sidewall, having opposed angled sidewalls on closure lugs, having opposed angled sidewalls on closure lug receiving notches, or having both lugs and receiving notches with angled sidewalls. Other retaining means include having a reinforcing band circumferentially surrounding a periphery of the closure and encircling a portion of the closure lugs and having a relatively short distance between the closure lugs and the top wall of the closure.

The closure lugs and the container bayonet lugs with closure lug receiving notches depicted in the various Figures are selected solely for the purpose of illustrating the present invention. Other and different closures and containers may utilize the inventive features described herein. Reference to the Figures showing several embodiments of the presently claimed invention is made to describe the presently claimed invention and not to limit the scope of the claims herein.

Figure 1:
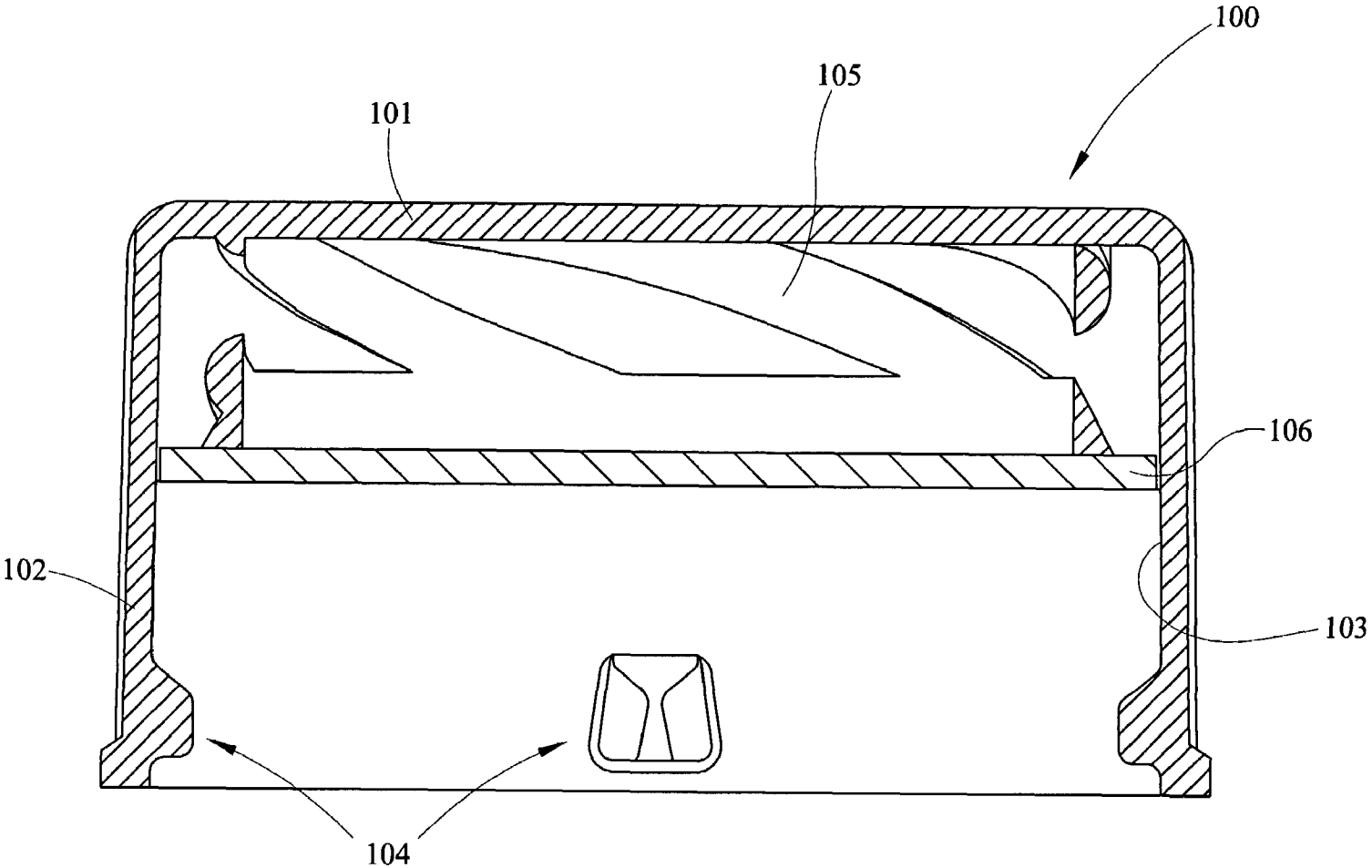
FIG. 1 is a cross-sectional view of an embodiment of the closure of the presently claimed invention showing closure lugs of specific structure and orientation.

FIG. 1 is a cross-sectional view of an embodiment of closure 100 of the presently claimed invention. Closure 100 has a top wall 101 and depending annular sidewall 102. Annular sidewall 102 has inner annular surface 103 where a plurality of closure lugs 104 project inward therefrom. Also shown here is spring member 105 depending from top wall 101 and being resiliently engageable with a container neck portion to bias safety closure 100 away from the container neck portion. Optional sealing disk 106 is shown adjacent spring 105.

Figure 2:
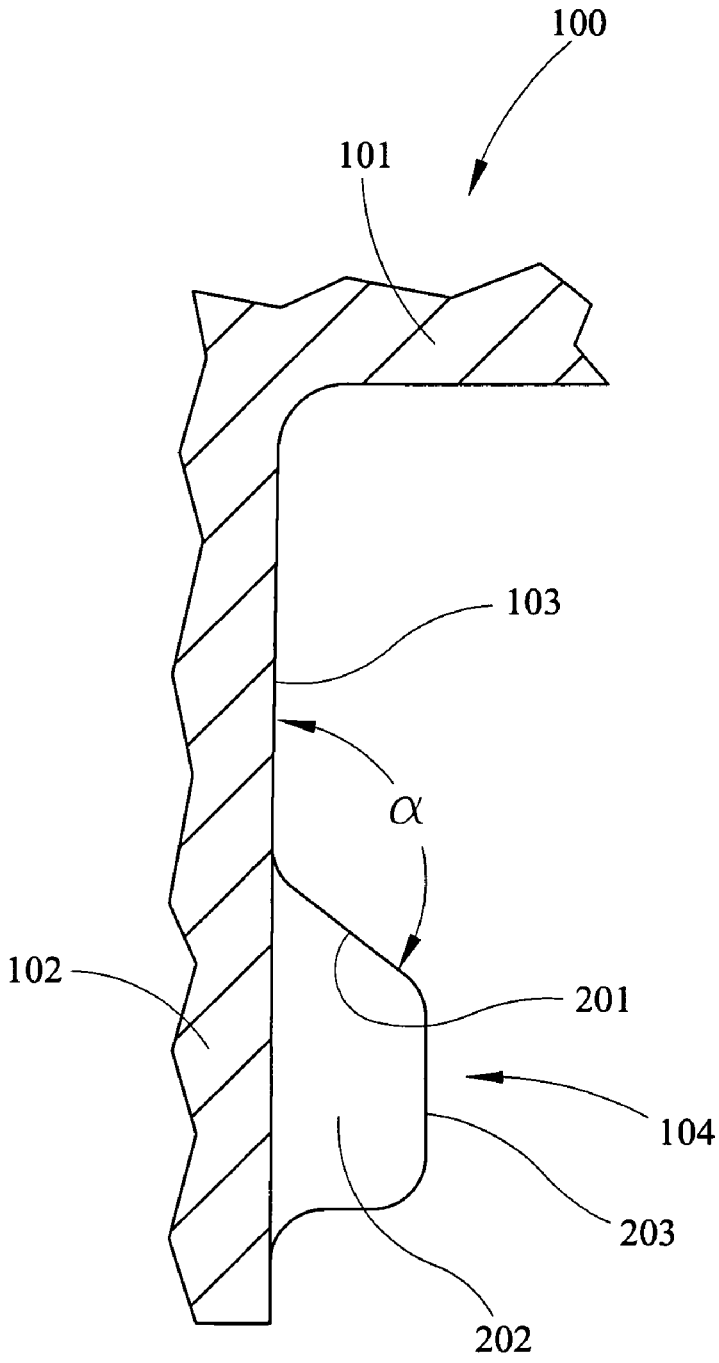
FIG. 2 is a side sectional view of a lug in the closure of FIG. 1 showing the angle of incidence between the top surface of the lug and the inner annular surface of the closure.

FIG. 2 is a side sectional view of lug 104 in closure 100. Lug 104 has lug top surface 201, front wall 203, and opposing sidewalls 202. Top surface 201 forms angle of incidence a with inner annular sidewall surface 103. Angle of incidence a is greater than 90° in each embodiment shown in the FIGs. and claimed herein. Having angle of incidence α greater than 90° permits closure lug 104 to rise over a lug forming portion of the mold core. Thus closure 100 may be more easily removed from a forming mold providing for a more efficiently manufacturable closure. Advantageously, α is greater than 115°. More advantageously α is less than about 150°. Most advantageously, α is greater than about 115° and less than about 150°.

Figure 3:
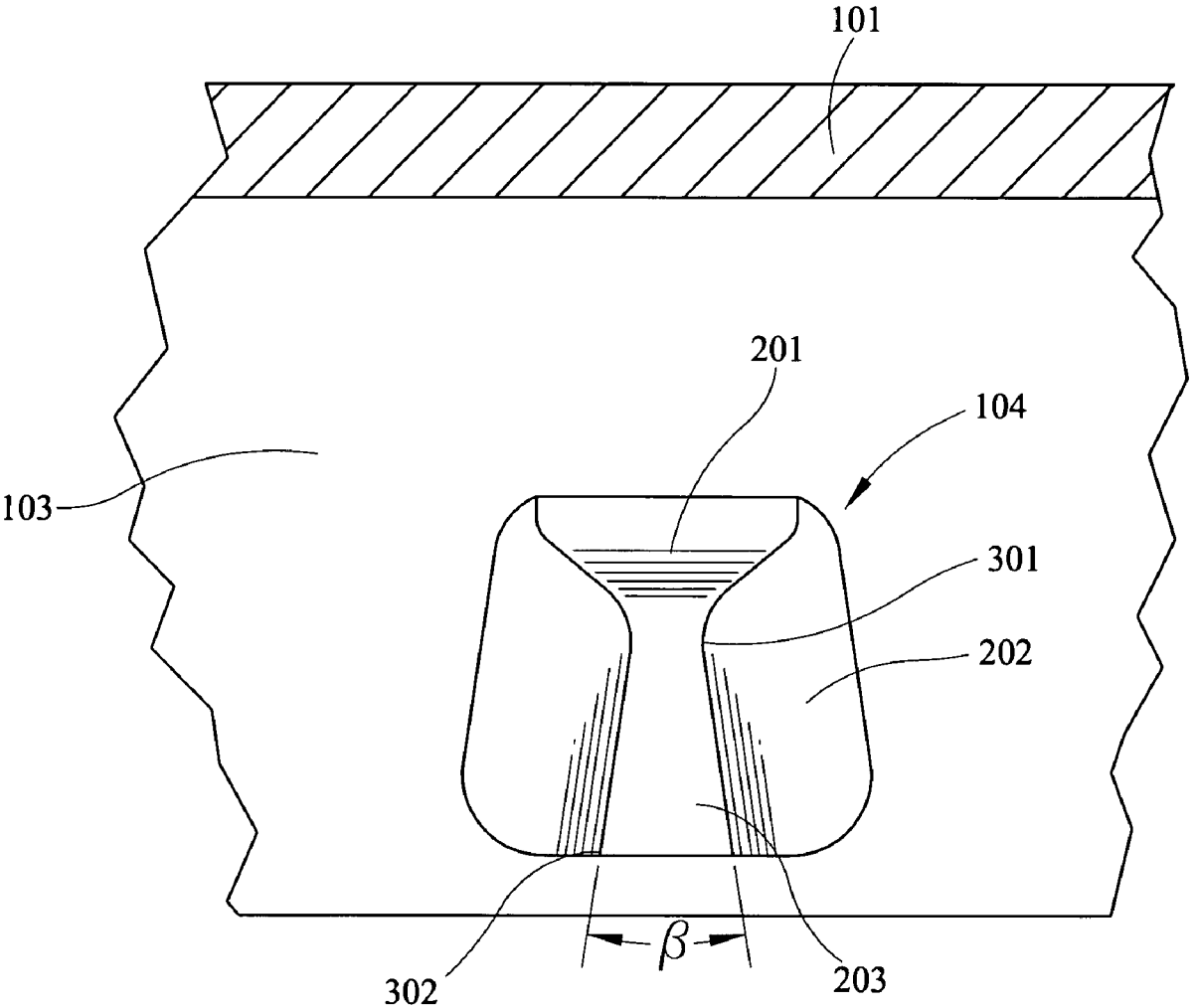
FIG. 3 is a front view of the lug in the closure of FIG. 1 showing the angle between the lug sidewalls.

FIG. 3 is a front view of lug 104 on annular sidewall inner surface 103. In this embodiment, an optional lug retaining means is incorporated into lug 104 by having a wedge shaped lug with a narrow end of the wedge closer to top wall 101 than the wider end of the wedge shaped lug 104. Closure lug 104 has two opposing sidewalls 202 forming an axial angle β there between. Lug sidewalls 202 each have an inner top edge 301 and an inner bottom edge 302, inner top edge 301 of two opposing sidewalls 202 are a first distance from one another, inner bottom edges 302 of the two opposing sidewalls are a second distance from one another, the second distance is greater than the first distance. This configuration of sidewalls 202 forms a wedge having a narrow end adjacent or nearer top wall 101. This wedge provides for gripping and secure seating within lug receiving notches on a container and thus provides resistance to an axial removal force placed on closure 100 when lug 104 is in a sealing position. This configuration allows for the use of a container having bayonet lugs with a variety of lug receiving notches as shown in the following Figures.

Figure 4:
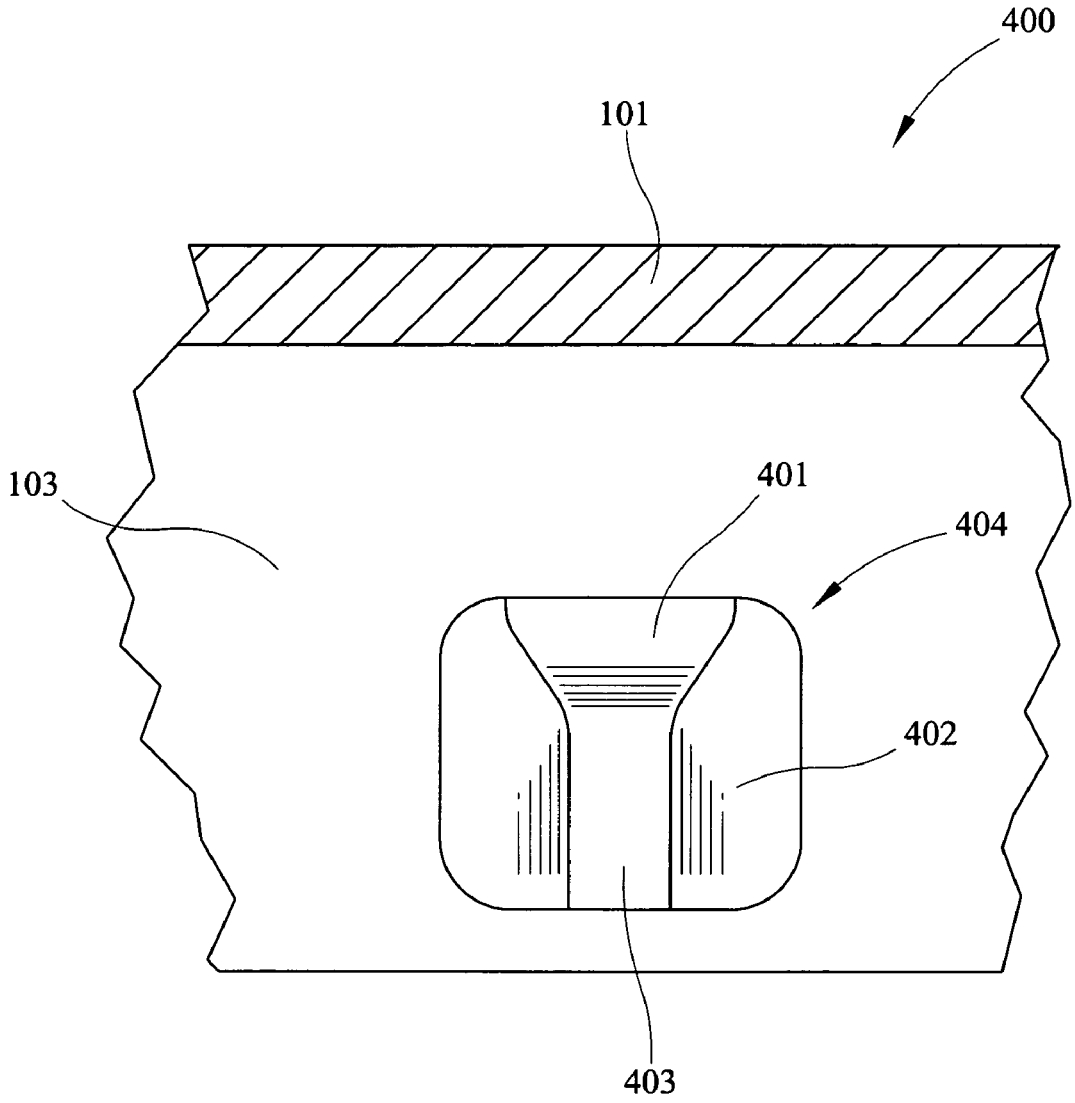
FIG. 4 is a front view of an embodiment of a closure lug of the presently claimed invention showing the sidewalls of the lug to be substantially in line with a vertical axis of the closure.

FIG. 4 is a front view of an embodiment of a closure lug 404 of the presently claimed invention showing sidewalls 402 of lug 404 to be substantially in line with a vertical axis of the closure. Lug top surface 401 forms an angle of incidence with inner annular sidewall surface 103 greater than 90°. This embodiment does not incorporate an optional retaining means in the closure but may be used with the containers in FIGS. 8 and 9 where bayonet lugs 801 and 901 have a closure lug receiving notch with sidewalls 804 and 904 having angle β with respect to a vertical axis of the container neck to provide additional resistance to axial removal. Containers 800 and 900 receive lug 404 in a receiving notch in a bayonet lug having axial angled sidewalls. Additionally, a closure having lug 404 may be used with a variety of bayonet lugs, such as closure 700 having lugs near a top wall as shown in FIG. 7 or a retaining band such as shown in FIG. 6.

Figure 5:
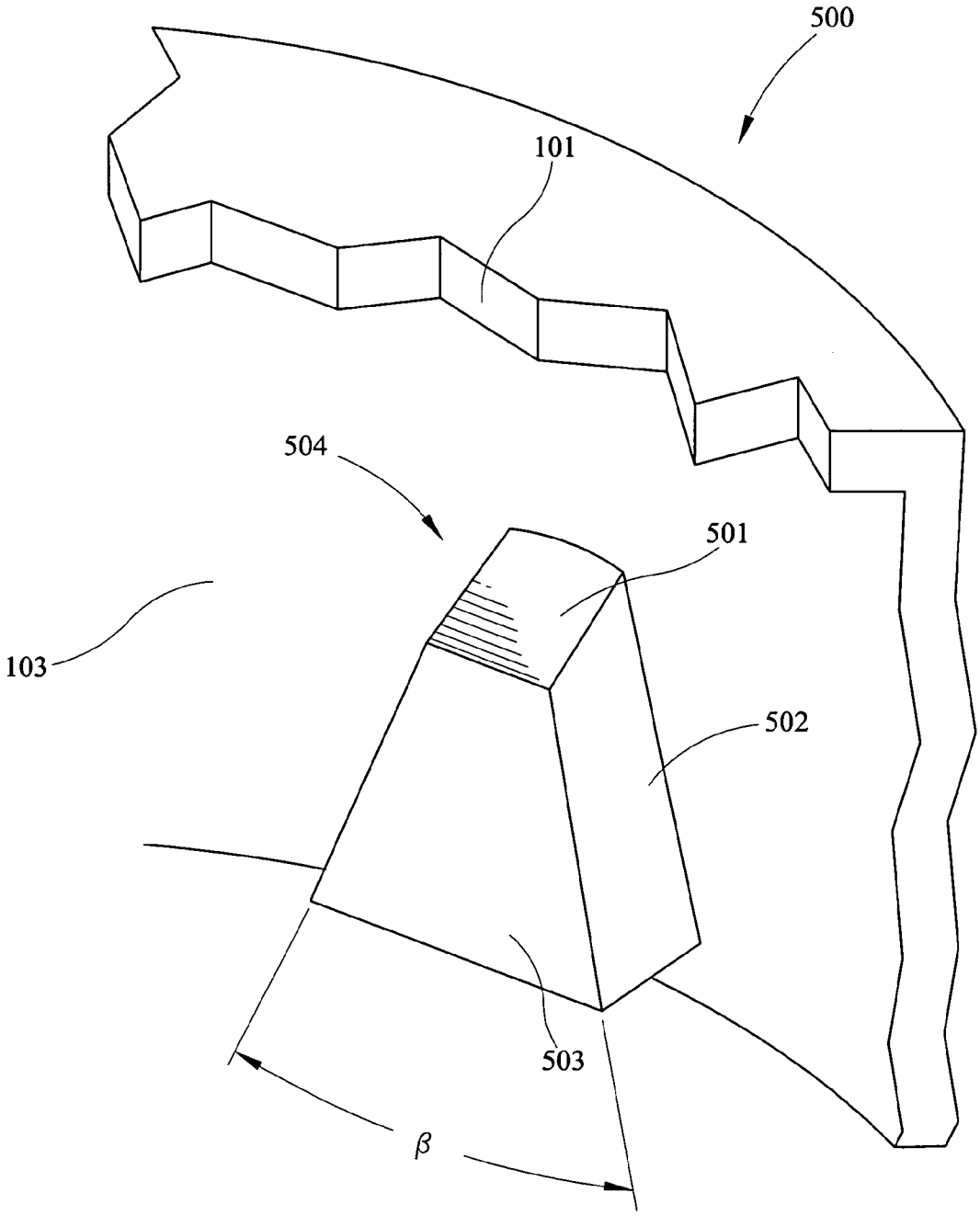
FIG. 5 is a perspective view of an embodiment of a closure of the presently claimed invention having an embodiment of a lug with sidewalls of the lug being angled with respect to a vertical axis of the closure.

FIG. 5 is a perspective view of an embodiment of closure 500 having lugs 504. This embodiment of the presently claimed invention has top surface 501 sloping away from top wall 101. Sidewalls 502 of lugs 504 are angled with respect to an axial axis of closure 500 forming angle β between sidewalls 502. In this embodiment, lug sidewalls 502 are not angled with respect to a horizontal axis or radial axis of closure 500. This configuration allows for the use of a container having bayonet lugs with a variety of lug receiving notches as shown in the following Figures.

Figure 6:
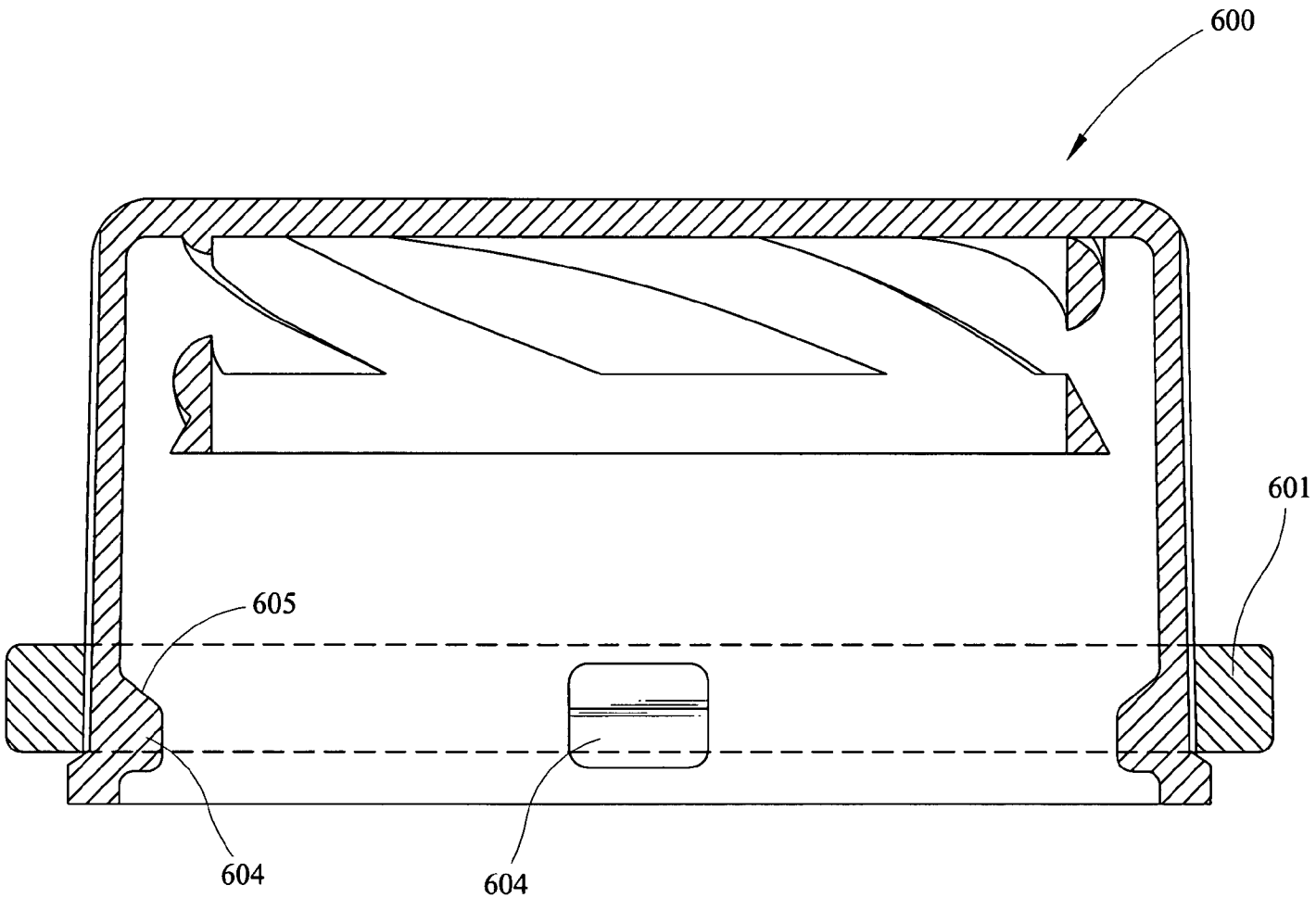
FIG. 6 is a cross-sectional view of an embodiment of the closure of the presently claimed invention showing square lugs having a sloping top surface and a reinforcing band around the closure.

FIG. 6 is a cross-sectional view of an embodiment of closure 600 of the presently claimed invention showing square lugs 604 having a sloping top surface 605. Top surface 605 slopes away from the closure top wall providing for a more efficiently manufacturable closure. This embodiment has a means for resisting axial removal of closure 600 from a container. Reinforcing band 601 circumferentially surrounds a periphery of closure 600 reducing the tendency of closure 600 from radially or horizontally expanding or 'going square' upon the exertion of an axial force on closure 600. Going square means that the lengths of the periphery of the closure between lugs tend to straighten thus causing the closure to loose its circular configuration. Reinforcing band 601 may be placed on closure 600 after removal from a forming mold thus providing for ease in manufacture.

Figure 7:
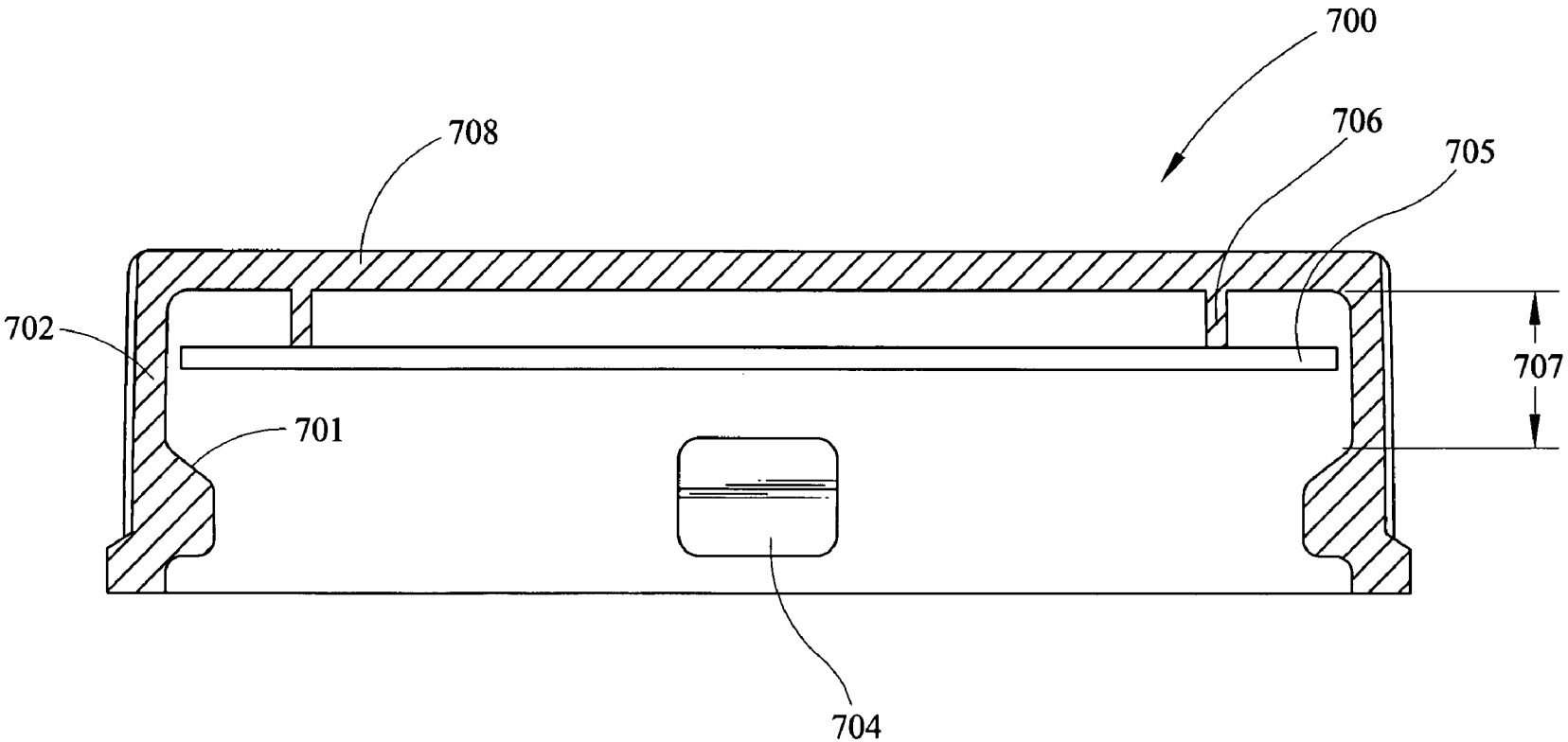
FIG. 7 is a cross-sectional view of an embodiment of the closure of the presently claimed invention having square lugs with a sloping top surface wherein the lugs are near a closure top wall.

FIG. 7 is a cross-sectional view of an embodiment of closure 700 of the presently claimed invention showing square lugs 704 having a sloping top surface 701. In this embodiment, lug 704 is located a relatively short distance from top wall 708 which is shown as distance 707. Disk spring 705 is separated from closure top wall 708 by depending ring or post 706. This is a relatively shallow spring configuration which contributes to shallow distance 707. Having a short distance 707 from top wall 708 to lug 704 reduces the tendency of the radial expansion or 'going square' of annular sidewall 702 when an axial force is placed on closure 700. Short distance 707, which may be as little as about 0.25 inches or even less, holds lugs 704 in bayonet lug receiving notches thus providing a means for reducing the tendency of unwanted removal of closure 700. Preferably distance 707 is an average of at most about 0.25 inches.

Figure 8:
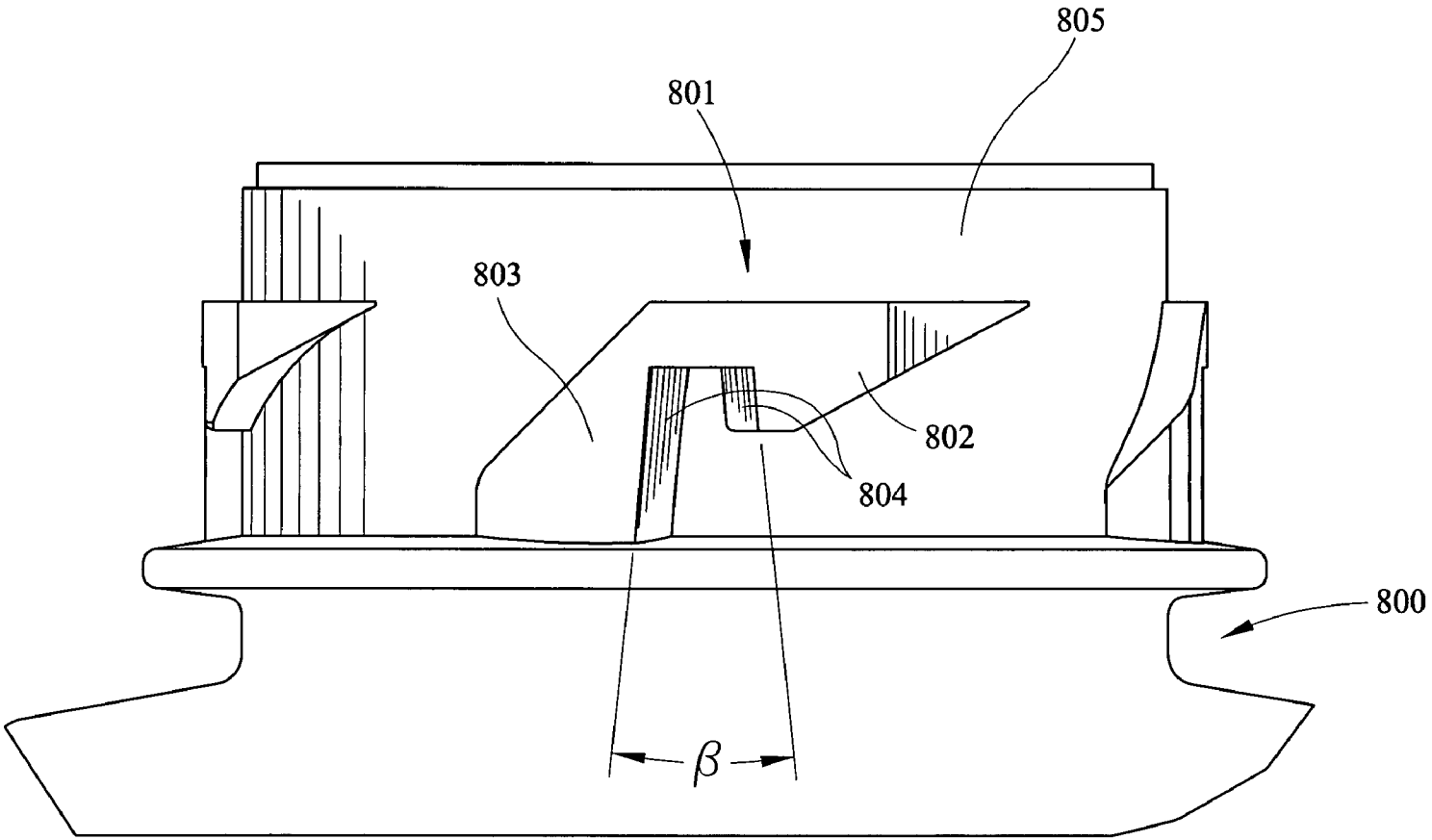
FIG. 8 is a front view of a container neck of the presently claimed invention showing bayonet lugs each having a closure lug receiving notch with sidewalls being angled with respect to a vertical axis and a horizontal axis of the container.

FIG. 8 is a front view of an embodiment of the presently claimed invention showing container 800 having bayonet leading end 802 and bayonet trailing end 803 joined to form bayonet lug 801 on container neck 805 having a closure lug receiving notch with sidewalls 804 being angled with respect to an axial or vertical axis and a horizontal or radial axis of container 800. Sidewalls 804 have angle β there between forming a container lug receiving wedge or notch where container lugs 104, 404, 504, 604, and 704 are received when closures 100, 400, 500, 600, and 700 are placed in a sealing position on container 800. The container lug receiving notch formed by sidewalls 804 engage the lug sidewalls on the closure to provide a resistance to an axial removal force placed on the closure thus reducing or preventing unwanted removal of the closure. A radial angle of sidewalls 804 is shown in this embodiment and is incorporated only to aid in manufacture by allowing halves of an injection blow mold to separate. Radially angled sidewalls 804 are not a limitation on the presently claimed invention. The present invention may have radially angled sidewalls 804 or radially straight sidewalls 1104.

Figure 9:
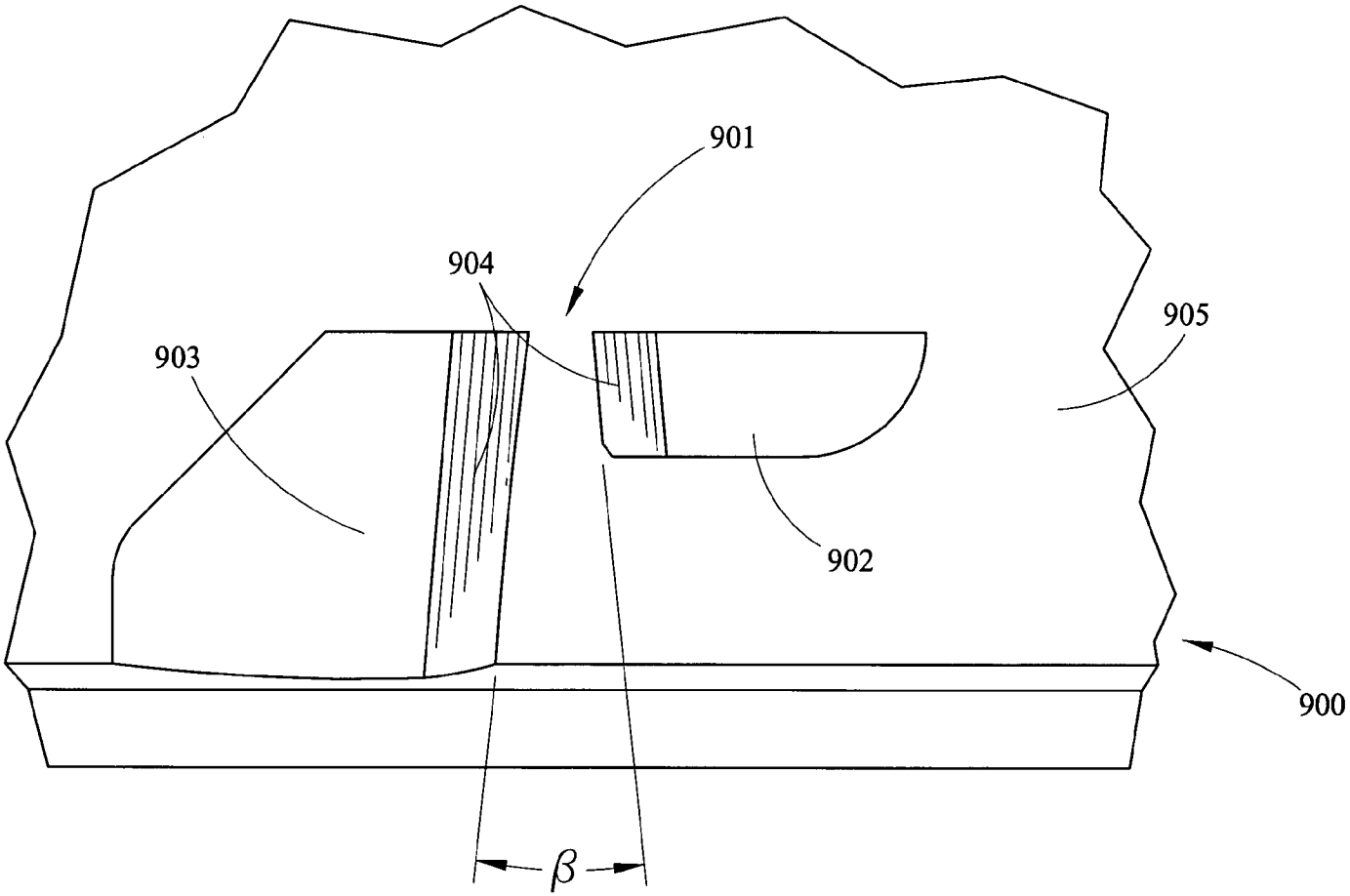
FIG. 9 is a front cut-away view of a container neck of the presently claimed invention showing a bayonet lug on a container neck having a closure lug receiving notch with sidewalls being angled with respect to a vertical axis and a horizontal axis of the container and having an open top.

FIG. 9 is a front cut-away view of a container neck 900 of the presently claimed invention showing a bayonet lug 901 on a container neck 905 having a closure lug receiving notch with sidewalls 904 being angled with respect to a vertical axis and a radial axis of the container and having an open top. Leading end 902 and trailing end 903 form bayonet lug 901. In this embodiment, leading end 902 and trailing end 901 are not joined and thus form a receiving notch having an open top. The angle β between sidewalls 904 forms a container lug receiving notch where container lugs 104, 404, 504, 604, and 704 are received when closures 100, 400, 500, 600, and 700 are placed in a sealing position on container 900. The angle β between sidewalls 904 provides for a wedge shaped lug receiving notch that provides for a closure retaining means. It is to be understood that radially angled sidewalls 904 are an option that may be employed to allow the use of injection blow molding to form the container 900.

Figure 10:
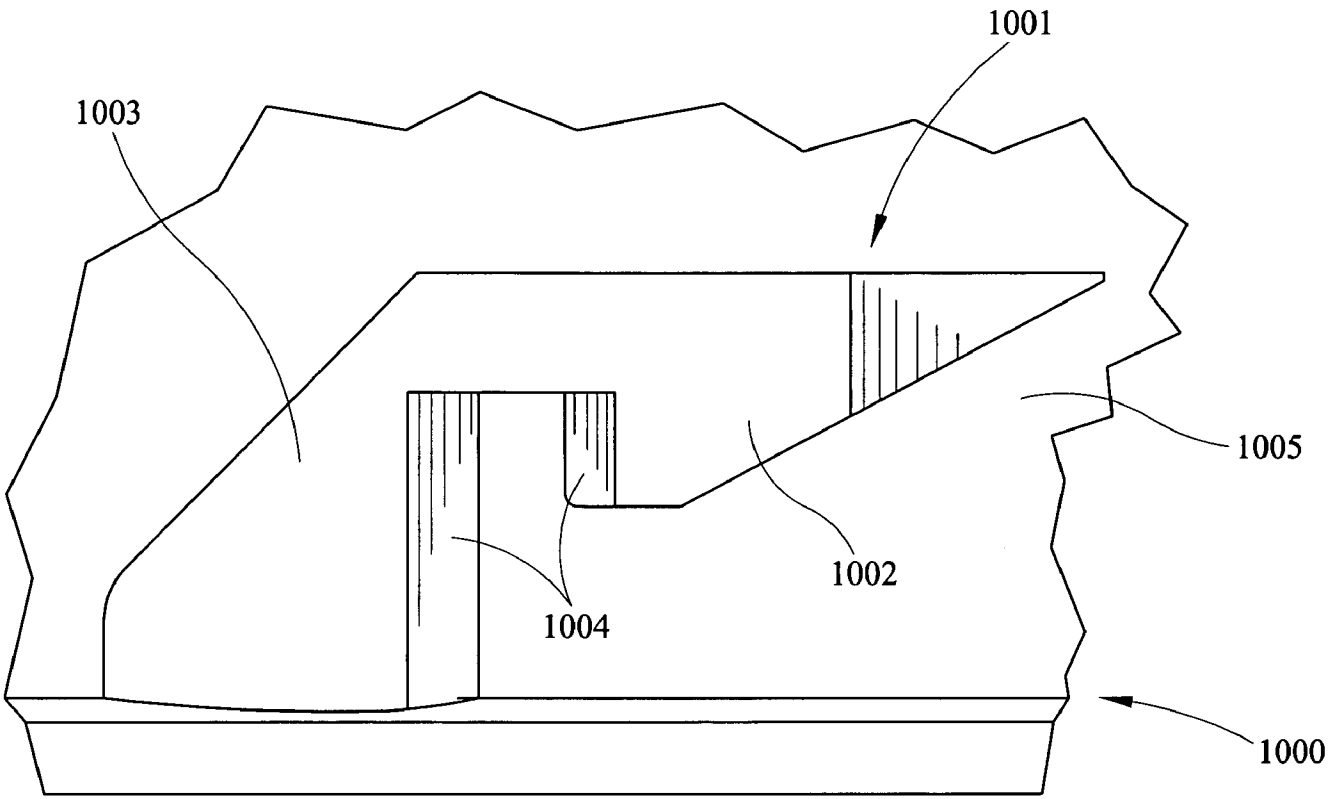
FIG. 10 is a close up view of an embodiment of the presently claimed invention showing a bayonet lug on a container neck having a closure lug receiving notch with sidewalls being angled with respect to a horizontal axis of the container.

FIG. 10 is a front cut-away view of an embodiment of the presently claimed invention showing bayonet lug 1001 on container neck 1005 having a closure lug receiving notch formed with sidewalls 1004 being angled with respect to a radial or horizontal axis of container 1000. This container lug receiving notch formed by leading edge 1002 being joined to trailing edge 1003 having sidewalls 1004 provides a resistance to an axial removal force placed on the closures 100,

500, 600, and 700 having lugs 104, 504, 604, and 704 thus preventing unwanted removal of the closure. The axial angle of sidewalls 1004 is not a limitation on this embodiment or any embodiment of the instant invention, it may be a result of a selected production method such as injection blow mold.

Figure 11:
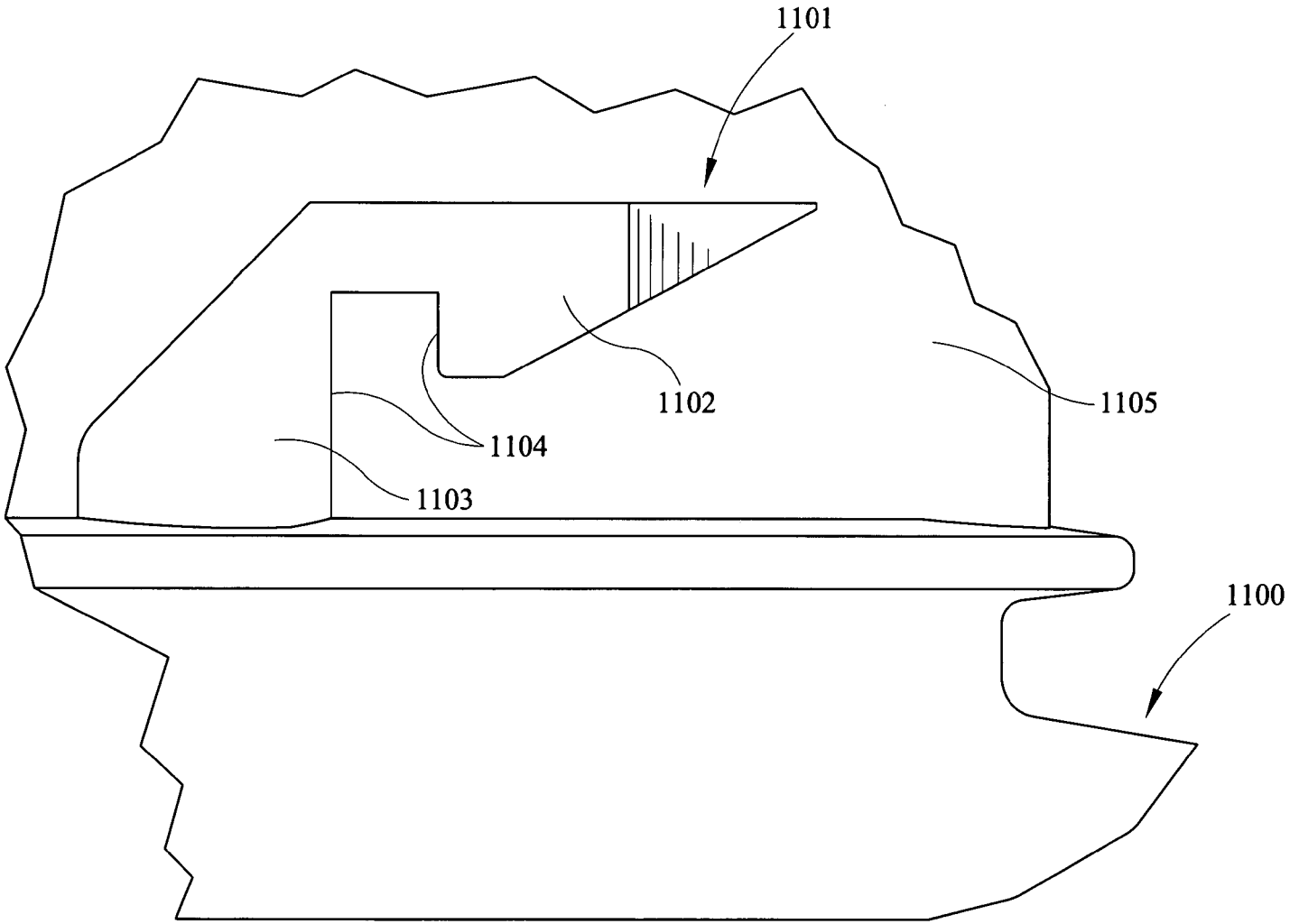
FIG. 11 is a front cut-away view of an embodiment of the presently claimed invention showing a bayonet lug on a container neck having a square closure lug receiving notch.

FIG. 11 is a front cut-away view of an embodiment of the presently claimed invention showing a bayonet lug on container neck 1105 having a square closure lug receiving notch. This container lug receiving notch formed by sidewalls 1104 provides a resistance to an axial removal force placed on the closures having lugs previously shown, thus preventing unwanted removal of the closure.

Figure 12:
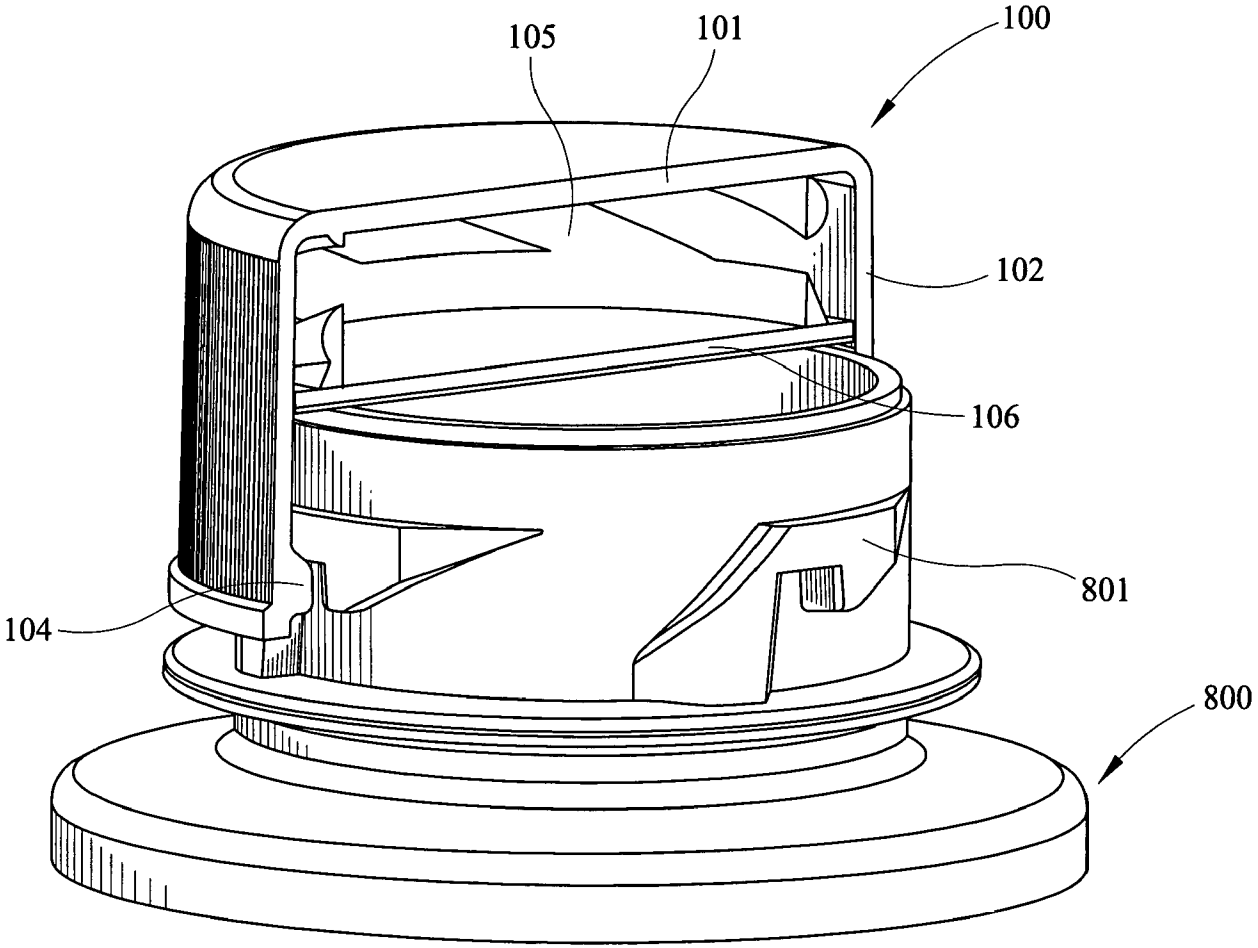
FIG. 12 is a perspective view of an embodiment of the presently claimed invention showing a bayonet lug of FIG. 8 on a container neck and a cross-sectional view of the closure of FIG. 1 in a sealing position on the container.

FIG. 12 is a perspective view of an embodiment of the presently claimed invention showing bayonet lug 801 of FIG. 8 on a container neck and a cross-sectional view of the closure 100 of FIG. 1 in a sealing position on container 800. Another optional retention method or closure retaining means of closure 100 on container 800 is hereby shown. A distance between the outer annular surface of the neck of container 800 and inner annular surface of closure 100 may be so small as to prevent the closure from 'going square'. This distance may be as little as about 0.005 inches or even less. Preferably this distance is an average of at most about 0.005 inches. Optional sealing disk 106 is shown adjacent spring 105 and is in sealing engagement with the upper most surface of the neck of container 800.

Figure 13:
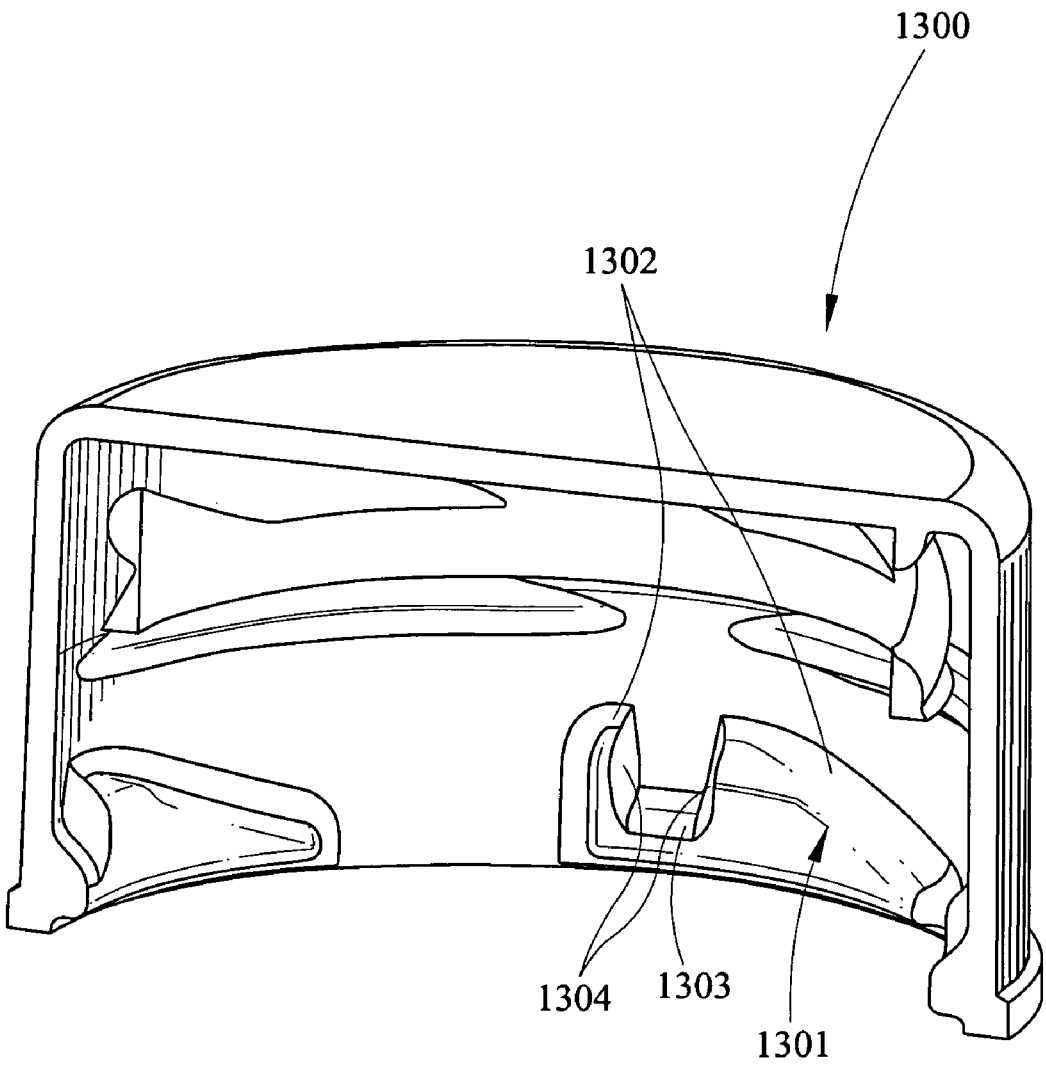
FIG. 13 is a perspective cross-sectional view of an embodiment of the presently claimed invention showing bayonet lugs on the inner annular surface of the closure.
Figure 14:
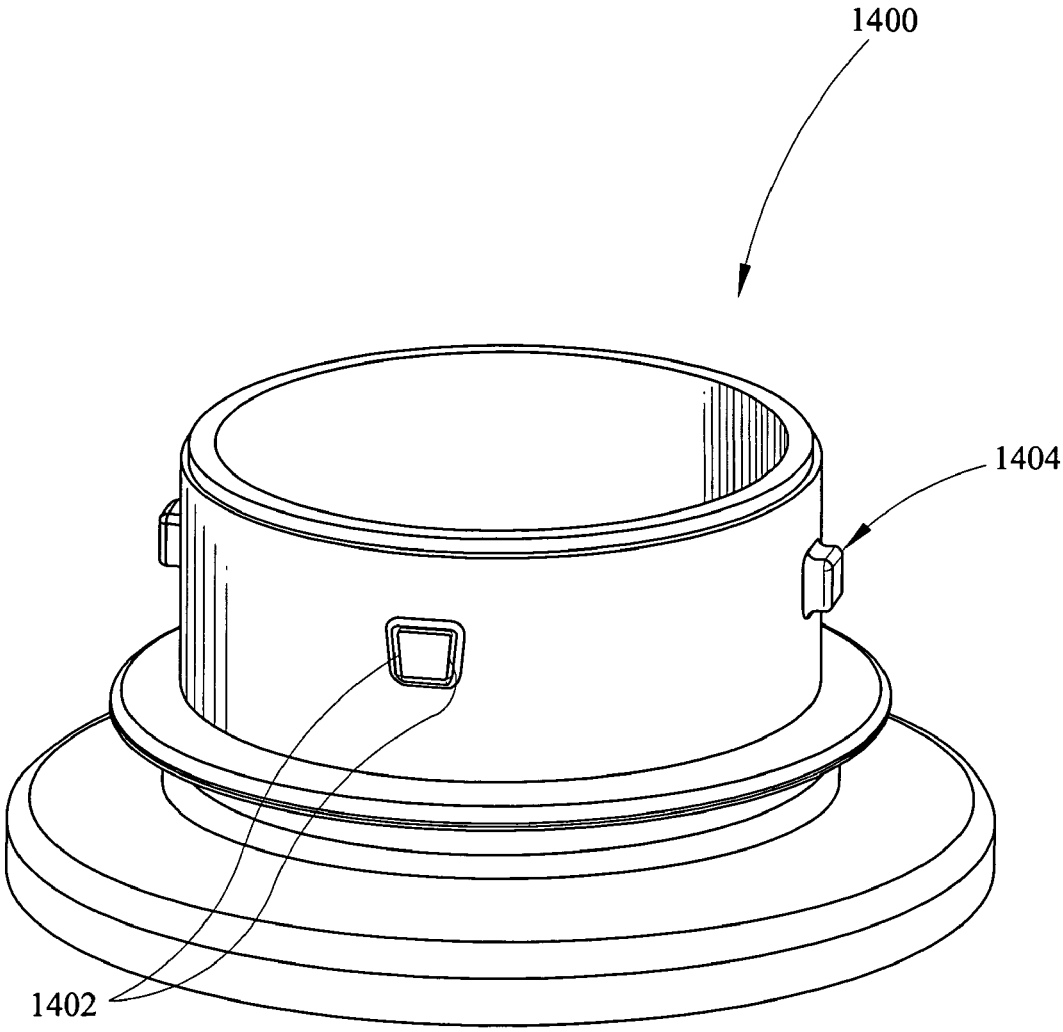
FIG. 14 is a perspective cross-sectional view of an embodiment of the presently claimed invention showing lugs the container neck.

FIG. 13 is a perspective cross-sectional view of an embodiment of the presently claimed invention showing bayonet lugs 1301 on the inner annular surface of closure 1300. In this embodiment, bayonet lug 1301 is located on the closure rather than on the neck of the container as in the previously shown embodiments. Bayonet Lug 1301 has a top surface 1302 that forms an angle of incidence with the inner annular surface of closure 1300 in excess of 90°. Additionally, container lug receiving notch bottom wall 1303 is sloped away form the inner annular surface in excess of 90°. This provides for the ability to axially remove closure 1300 from a forming mold without the need for a collapsible mold or other special production method. Also shown here are lug receiving notch sidewalls 1304 having an inward axial angle forming a wedge providing an optional means for retaining container lugs. FIG. 14 is a perspective sectional view of an embodiment of the presently claimed invention showing container neck 1400 having lugs 1404 that are matingly engageable with the closure of FIG. 13. In this embodiment, container lugs 1404 have sidewalls 1402 that are axially angled to matingly engage with bayonet lugs 1301 providing for an additional closure retaining means.

The present invention provides for a more efficiently manufacturable safety closure having lugs for use on containers. The safety closure of the present invention has lugs on an inner annular surface with upper surfaces having an angle of incidence with the inner annular surface of the closure in excess of 90° to allow the closure to be more easily removed from a forming mold. Typically, the closure is formed on a core mold and axially removed. Lugs on a closure having upper surfaces perpendicular to the axis of the closure prevent axial removal unless the core mold is first collapsed or other expensive manufacturing method is employed, as is associated with the prior art. The configuration of having lugs with upper surfaces with an angle of incidence in excess of 90° with the sidewall allows the closure to be axially removed from a non-collapsible mold core and illuminates a necessity of employing other expensive manufacturing methods. Also, the presently claimed invention incorporates several optional closure retaining means or means for preventing axial removal of a closure when a closure is in a sealing position on a container. These optional means for preventing axial removal of a closure include having a wedge shaped lug, a wedge shaped lug receiving notch in a bayonet lug, a wedge shaped lug and a wedge shaped receiving notch, a reinforcing band on a container, a tight fit between a closure and container, and a short distance from a container top wall to a container lug.

We claim:

1. An efficient manufacturable safety bayonet closure comprising:

a top wall and a depending annular sidewall, said annular sidewall having a plurality of closure bayonet lugs projecting inward therefrom, each of said plurality of closure bayonet lugs are substantially aligned in a horizontal plane spaced from said top wall, each of said bayonet lugs having a lug top surface forming an angle of incidence with said annular sidewall, said angle of incidence being greater than 90° and at most about 150°;

a biasing spring resiliently engageable with said top wall of said closure and engageable with a rim of a container to bias said closure bayonet lugs against a container neck finish;

wherein said closure bayonet lugs have two opposing sidewalls angled towards each other, said lug sidewalls having an inner top edge and an inner bottom edge, said inner top edges of said two opposing sidewalls being a first distance from one another, said inner bottom edges of said two opposing sidewalls being a second distance from one another, said second distance being greater than said first distance, and wherein an inner front wall joins the opposing sidewalls, said inner front wall is being tapered in the direction of said lug top surface from a larger width near said inner bottom edges to a smaller width near said inner top edges.

2. The bayonet closure of claim 1 wherein said angle of incidence is between about 115° and about 150°.

3. The closure of claim 1 wherein said closure has a reinforcing band circumferentially surrounding a periphery of said closure having said plurality of closure lugs.

4. The bayonet closure of claim 1 having a sealing disk adjacent said spring and encircled by said annular side wall of said closure.

5. The bayonet closure as in claim 1 wherein opposing sidewalls of each of said bayonet lugs tapering inwardly towards each other from a lower end of said bayonet lug into said top surface of said bayonet lug.

6. The bayonet closure as in claim 1 wherein opposing sidewalls of each of said bayonet lugs tapering inwardly towards each other from said annular sidewall of said closure into a front wall of said bayonet lug.

7. The bayonet closure of claim 1 wherein said horizontal plane of said bayonet lugs spaced an average of at most about 0.25 inches from said top wall.

8. The closure of claim 7 wherein said closure has a disk spring, said disk spring being separated from said closure top wall by a depending post.

* * * * *